US011136718B2

(12) United States Patent
Dawson et al.

(10) Patent No.: US 11,136,718 B2
(45) Date of Patent: Oct. 5, 2021

(54) THROUGH-AIR DRYER SHOWER ASSEMBLY

(71) Applicant: Kimberly-Clark Worldwide, Inc., Neenah, WI (US)

(72) Inventors: Mark K. Dawson, Beggs, OK (US); Richard M. Hansen, Oshkosh, WI (US); Daniel D. Jacobson, Winneconne, WI (US); Jonathan P. Godden, Tulsa, OK (US); Lori M. Willis, Sapulpa, OK (US); Molly S. Mooren, Appleton, WI (US); Raymond G. Heckner, Sherwood, WI (US); Stephen J. Reilly, Sperry, OK (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/966,947

(22) PCT Filed: Jan. 9, 2020

(86) PCT No.: PCT/US2020/012851
§ 371 (c)(1),
(2) Date: Aug. 3, 2020

(87) PCT Pub. No.: WO2021/141586
PCT Pub. Date: Jul. 15, 2021

(65) Prior Publication Data

US 2021/0214892 A1 Jul. 15, 2021

(51) Int. Cl.
*D21F 5/18* (2006.01)
*D21H 27/00* (2006.01)
*D21F 11/14* (2006.01)

(52) U.S. Cl.
CPC ..... *D21F 5/182* (2013.01); *D21F 11/145* (2013.01); *D21H 27/002* (2013.01)

(58) Field of Classification Search
CPC . D21F 5/182; D21F 5/184; D21F 1/34; D21F 1/345; D21F 3/10; D21F 3/105; D21F 11/145; D21H 27/002
See application file for complete search history.

(56) References Cited

U.S. PATENT DOCUMENTS 3,300,374 A * 1/1967 Baker ..... D21F 3/10 162/276
3,754,559 A 8/1973 Seiwert
(Continued)

FOREIGN PATENT DOCUMENTS

CN 202061758 U 12/2011
CN 202809379 U 3/2013
(Continued)

OTHER PUBLICATIONS

ROBOPAPER, "TAD Cleaner", https://www.robopaper.nl/en/tad-cleaner.

*Primary Examiner* — Eric Hug
(74) *Attorney, Agent, or Firm* — Kimberly-Clark Worldwide, Inc.

(57) ABSTRACT

Disclosed is a through-air dryer shower assembly disposed within the through-air dryer and enables efficient cleaning of the through-air dryer without having an operator enter the dryer. The shower may comprise an elongated shower conduit having a plurality of nozzles disposed thereon and may be affixed to a baffle disposed within the through-air dryer cylinder. The shower assembly is generally positioned to spray a pressurized stream of wash fluid against the interior surface of the dryer causing debris accumulated within the deck to flow through the structure to the outer surface for discharge.

9 Claims, 7 Drawing Sheets

(56) References Cited

U.S. PATENT DOCUMENTS

| | | | | |
|---|---|---|---|---|
| 4,542,596 | A * | 9/1985 | Bryand | D21F 5/143 34/115 |
| 5,791,065 | A | 8/1998 | Gamble et al. | |
| 6,877,246 | B1 * | 4/2005 | Hada | D21F 5/182 34/119 |
| 7,144,478 | B1 | 12/2006 | Sekiya | |
| 2007/0051009 | A1 | 3/2007 | Hada et al. | |
| 2013/0263898 | A1 | 10/2013 | Takei et al. | |
| 2019/0024313 | A1 * | 1/2019 | Parker | D21F 5/02 |

FOREIGN PATENT DOCUMENTS

| | | | |
|---|---|---|---|
| CN | 205183215 | U | 4/2016 |
| CN | 206034188 | U | 3/2017 |
| CN | 208810660 | U | 5/2019 |
| CN | 209006259 | U | 6/2019 |
| CN | 209338907 | U | 9/2019 |
| DE | 102009016425 | A1 | 10/2009 |
| DE | 102009000747 | A1 | 8/2010 |
| JP | 3008883 | A | 1/1991 |

* cited by examiner

THROUGH-AIR DRYER SHOWER ASSEMBLY

BACKGROUND

In the manufacture of high-bulk tissue products, such as facial tissue, bath tissue, paper towels, and the like, it is common to use one or more through-air dryers for partially drying the web or to bring the tissue web to a final dryness or near-final dryness. Through-air dryers typically include a rotating cylinder having an upper deck that supports a drying fabric which, in turn, supports the web being dried. Heated air is passed through the web in order to dry the web. For example, in one embodiment, heated air is provided by a hood, which is generally retractable, and at least partially covers the drying cylinder. Alternatively, heated air is provided to a center area of the drying cylinder and passed through to the hood.

When incorporated into a papermaking system, through-air dryers offer many and various benefits and advantages. For example, through-air dryers are capable of drying tissue webs without compressing the web. Thus, moisture is removed from the webs without the webs losing a substantial amount of bulk or caliber. In fact, through-air dryers, in some applications, may even serve to increase the bulk of the web. Through-air dryers are also known to contribute to various other important properties and characteristics of the webs.

Although through-air dryers are widely used for the drying of fibrous webs, and particularly tissue webs, they are notoriously difficult to clean. Because they are often designed to draw heated air through the fibrous web and then through their porous outer surface, they often become fouled with fibers, papermaking additives and other contaminates. The fiber, additives and contaminates often become lodged in the dryer's porous outer surface and must be removed to ensure efficient operation of the dryer. The contaminates are typically removed by an operator who accesses the interior portion of the dryer and manually sprays the inner surface of the dryer with a pressurized stream of wash fluid. This process is labor intensive and potentially hazardous.

Thus, there remains a need in the art for a dryer having a shower assembly that enables washing of the interior surface of the dryer and the removal of contaminates from the outer porous surface without having an operator enter the interior of the dryer.

SUMMARY

It has now been discovered that a through-air dryer may be provided with a shower assembly which enables efficient cleaning of the through-air dryer without having an operator enter the dryer. The shower assembly is disposed within the through-air dryer and is generally stationary. The shower assembly, which may comprise an elongated shower conduit having a plurality of nozzles disposed thereon, may be affixed to a baffle disposed within the through-air dryer cylinder and positioned to spray a pressurized stream of wash fluid against the interior surface of the dryer. Thus, in certain embodiments, the present invention provides a means for washing the porous cylindrical deck of a through-air dryer by spraying a wash fluid onto the inner surface of the deck causing debris accumulated within the deck to flow through the structure to the outer surface for discharge.

In other embodiments the present invention provides a through-air drying apparatus having radial, axial and tangential directions, the drying apparatus comprising a drying cylinder rotatable about a central axis having a porous cylindrical deck having an inner and outer surface, a pair of spaced apart headers and a journal supporting the headers; a baffle disposed within the rotatable cylinder, the baffle having a baffle support shaft that is axially aligned with the journal, a cylindrical shell and a dead plate; and a shower assembly attached to the dead plate, the shower assembly comprising a wash fluid supply conduit extending radially outward from the baffle support shaft, a spray conduit extending substantially parallel to the support shaft and in fluid communication with the wash fluid supply conduit and a plurality of immediately successive nozzles disposed on the spray conduit.

In another embodiment the present invention provides a through-air drying apparatus having radial, axial and tangential directions and rotatable about a central axis, the drying apparatus comprising: a rotatable cylinder having a porous cylindrical deck having an inner and outer surface, a pair of spaced apart headers and a journal supporting the headers and rotatable about the central axis; a baffle disposed within the rotatable cylinder, the baffle having a cylindrical shell, a baffle support shaft and a plurality of spokes connecting the cylindrical shell to the baffle support shaft; and a shower assembly comprising an elongated conduit extending lengthwise relative to the porous cylindrical deck and positioned between the inner surface of the porous cylindrical deck and the baffle support shaft, the conduit provided with a plurality of spaced apart nozzles arranged to direct a wash fluid towards the inner surface of the porous cylindrical deck. In still another embodiment the present invention provides a baffle for use in a through-air dryer, the baffle comprising a cylindrical porous baffle shell disposed around and supported by a shaft, a plurality of spokes connecting the baffle shell to the shaft, a dead plate connected to the support shaft and positioned radially outward from the baffle shell and a shower assembly attached to the dead plate. In a particularly preferred embodiment, the shower assembly comprises a wash fluid supply conduit extending radially outward from the baffle support shaft, a spray conduit extending substantially parallel to the support shaft and in fluid communication with the wash fluid supply conduit and a plurality of immediately successive nozzles disposed on the spray conduit.

In yet other embodiments the present invention provides a method of washing the porous cylindrical deck of a through-air dryer comprising the steps of: cooling the through-air dryer to a temperature less than about 60° C.; rotating the through-air dryer; supplying a wash fluid to a shower assembly comprising an elongated conduit extending lengthwise relative to the porous cylindrical deck and positioned internal to the porous cylindrical deck, the conduit provided with a plurality of spaced apart nozzles arranged to direct a wash fluid towards the porous cylindrical deck; and spraying a wash fluid from the plurality of nozzles and through the porous cylindrical deck.

DETAILED DESCRIPTION

Figure 1:
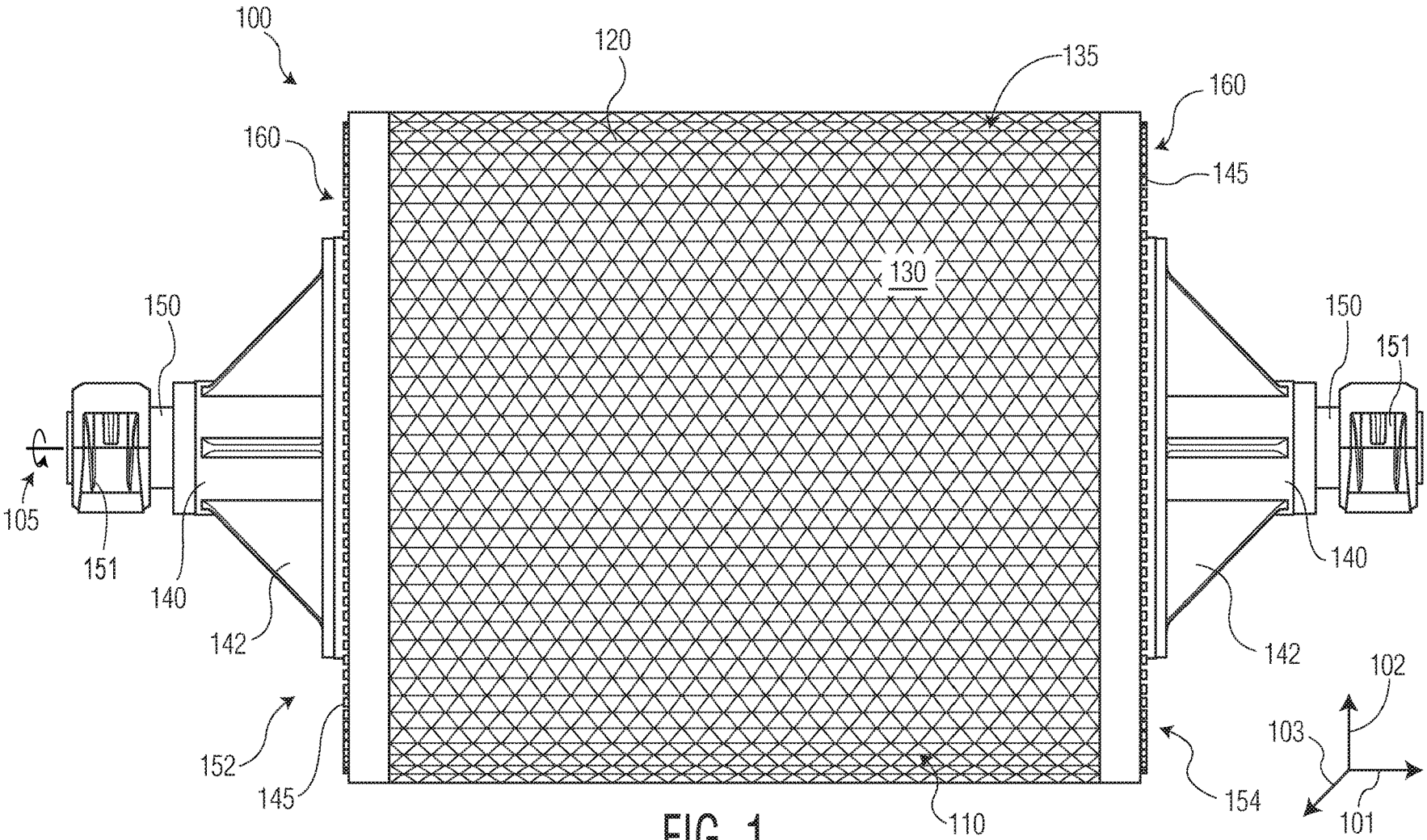
FIG. 1 is a front view of a cylindrical dryer.

The present invention generally provides a shower assembly for cleaning a cylindrical dryer, particularly when the dryer is out of service but rotating about the shower assembly. The shower assembly is preferably fixedly disposed within the cylindrical dryer and more preferably attached to a baffle disposed within the dryer. Accordingly, in certain embodiments the present invention provides a cylindrical dryer, particularly a through-air dryer, having a long cylindrical shell mounted to a journal rotatable about its central axis. Extending longitudinally through the cylindrical dryer shell is a shower assembly which is supported independently of the cylindrical shell. In certain instances, the shower assembly may be attached to, and supported by, a baffle disposed within the cylindrical dryer shell. The baffle may comprise a baffle support shaft having a central aperture in which a conduit supplying wash fluid to the shower assembly may be disposed. Thus, the baffle may support the shower assembly and facilitate delivery of a wash fluid without interfering with the normal operation of the dryer.

The shower assembly is particularly well suited for use in a through-air drying system, which is commonly used for drying of a wide variety of web materials, particularly fibrous webs and more particularly fibrous tissue webs that may be converted into tissue products such as facial tissue, bath tissue, paper towels, and the like. For example, the shower assembly may be incorporated in a through-air dryer comprising a retractable hood and a drying cylinder. A drying medium such as a heated gas, and more particularly heated air, is introduced to the system and used to dry the web as it is transported along the drying cylinder.

In certain instances, a burner may be used to heat ambient air, which may then be forced by a fan into the hood. The hood, in turn, directs the heated air through the web carried on the through-air drying fabric. The heated air is drawn through the web, drying the web, and through the surface of the drying cylinder. In certain embodiments at least a portion of the hot air is re-circulated back to the burner using a fan. In one embodiment, in order to avoid the build-up of moisture in the system, a portion of the spent heated air is vented, while a proportionate amount of fresh make-up air is fed to the burner.

While in certain embodiments heated air travels from the hood through the tissue web and then through the drying cylinder, the invention is not so limited. In other embodiments, the heated air may be fed through the drying cylinder and then forced into the hood. Regardless of the direction of air flow in the through-air dryer, heated air is passed through the tissue web as it is supported by a through-air drying fabric to dry the web.

Generally, a wet paper web, such as a tissue web, is transported on a through-air drying fabric, which may be a continuous belt of porous construction forming a loop around the cylindrical dryer. The drying cylinder and fabric may be arranged such that the fabric is wrapped about a portion of the circumference of the dryer, such as from about 50 to about 80 percent, such as from about 60 to about 75 percent. In addition to the cylindrical dryer, the through-air drying fabric may loop one or more fabric supports that may include, for example, a vacuum box, a rotatable roll, or the like. As the wet paper web is transported across the drying cylinder by the through-air drying fabric, the drying medium, which may be a heated gas such as air, or a hot vapor such as steam, passes through the web using applied differential pressure. Water is then removed from the web by the drying medium principally by the mechanism of forced convection.

The through-air drying system generally comprises a drying cylinder having a porous cylindrical deck over which a web is transported and dried. With reference to FIG. 1, a through-air dryer 100, also referred to herein simply as a dryer, useful in the present invention is illustrated. The through-air dryer 100 comprises a rotatable drying cylinder 110 having an axial 101, tangential 102 and radial 103 direction. The drying cylinder 110 comprises a cylindrical deck 120, which forms the outer most surface 130 of the dryer 100. In use the cylindrical deck may support a through-air drying fabric, which in turn, may support a web to be dried by the through-air drying apparatus.

The drying cylinder generally has a porous surface. For example, as illustrated in FIG. 1, the drying cylinder 110 has a honeycomb-type structure 135 that permits air flow through the drying cylinder 110 but yet has sufficient integrity for use in the process. In use the porous surface may become fouled with fiber, papermaking additives or other contaminates. This fouling may reduce the porosity of the dryer cylinder and reduce efficiency. The shower assembly of the present invention, which generally discharges a pressured fluid from the inside of the drying cylinder and through the porous surface, is particularly well suited for removing debris from the drying cylinder surface.

The cylindrical deck 120 is generally connected to a pair of spaced apart headers 160, which are in turn connected to hubs 140 by a plurality of spokes 142. In this manner the pair of spaced apart headers 160 form a portion of the first and second ends 152, 154 of the drying cylinder 110. The header 160 may be fastened to the cylindrical deck 120 by a plurality of bolts 145 spaced about the header 160 near its peripheral edge.

With continued reference to FIG. 1, the dryer 100 may comprise a stationary support shaft 150, or journal, that is concentrically positioned with respect to the cylindrical deck 120 and rotatable about an axis of rotation 105. The journal 150 may extend from a first side 152 and a second side 154 such that the dryer 100 is mountable and rotatable about the axis of rotation 105.

In certain instances, the pair of journals 150 extending axially 101 outwardly from either end of the cylindrical dryer 152, 154 may be carried by a pair of journal bearings 151. In certain instances, the journal may extend beyond the bearing and carry a seal bearing on its outermost end. Generally, the journal, and any extending portion, are hollow and allow the passage of a duct member which may house plumbing, such as one or more conduits for transporting a wash fluid, for the shower assembly.

In other embodiments the drying cylinder may include various other internal components that assist in supporting the cylindrical deck. For instance, the drying cylinder may include a tube disposed over the hub, internal support members, or a deck support ring, that all rotate with the cylindrical deck. The internal support members may be attached to the rotating tube on one end and to the deck support ring on an opposite end. In this manner, the deck support ring may support the cylindrical deck at a mid-region between each end of the cylindrical deck. The internal support members can be in the shape of plates and can assist in directing air flow through the dryer. The internal support members may be of a single piece construction or may be of a multi-piece construction as desired.

The cylindrical deck may be made from a single piece of welded steel having a honeycombed structure providing high structural strength while having a high amount of open area to permit air flow therethrough, or it may comprise a plurality of individual plates. In those embodiments where the deck comprises a plurality of plates, the plates may be connected to the deck support ring in a manner that allows thermal expansion. For instance, in one embodiment, each plate may include an indentation into which the deck support ring is received. In this manner, the plates may move relative to the deck support ring while remaining supported by the deck support ring.

Figure 2:
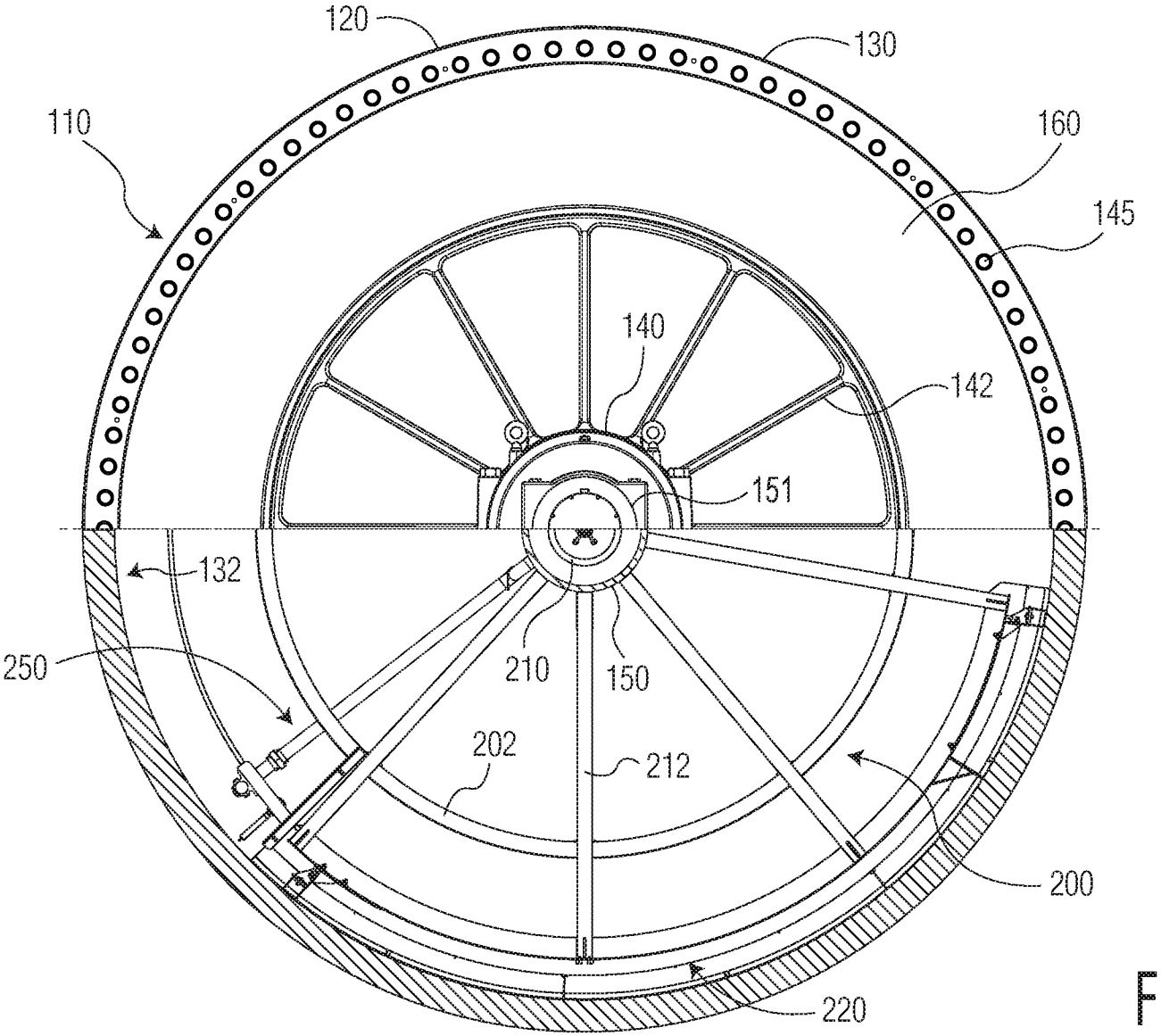
FIG. 2 is an end-view of a cylindrical dryer with a portion cutaway to illustrate a portion of a baffle and a shower assembly according to one embodiment of the present invention.
Figure 3:
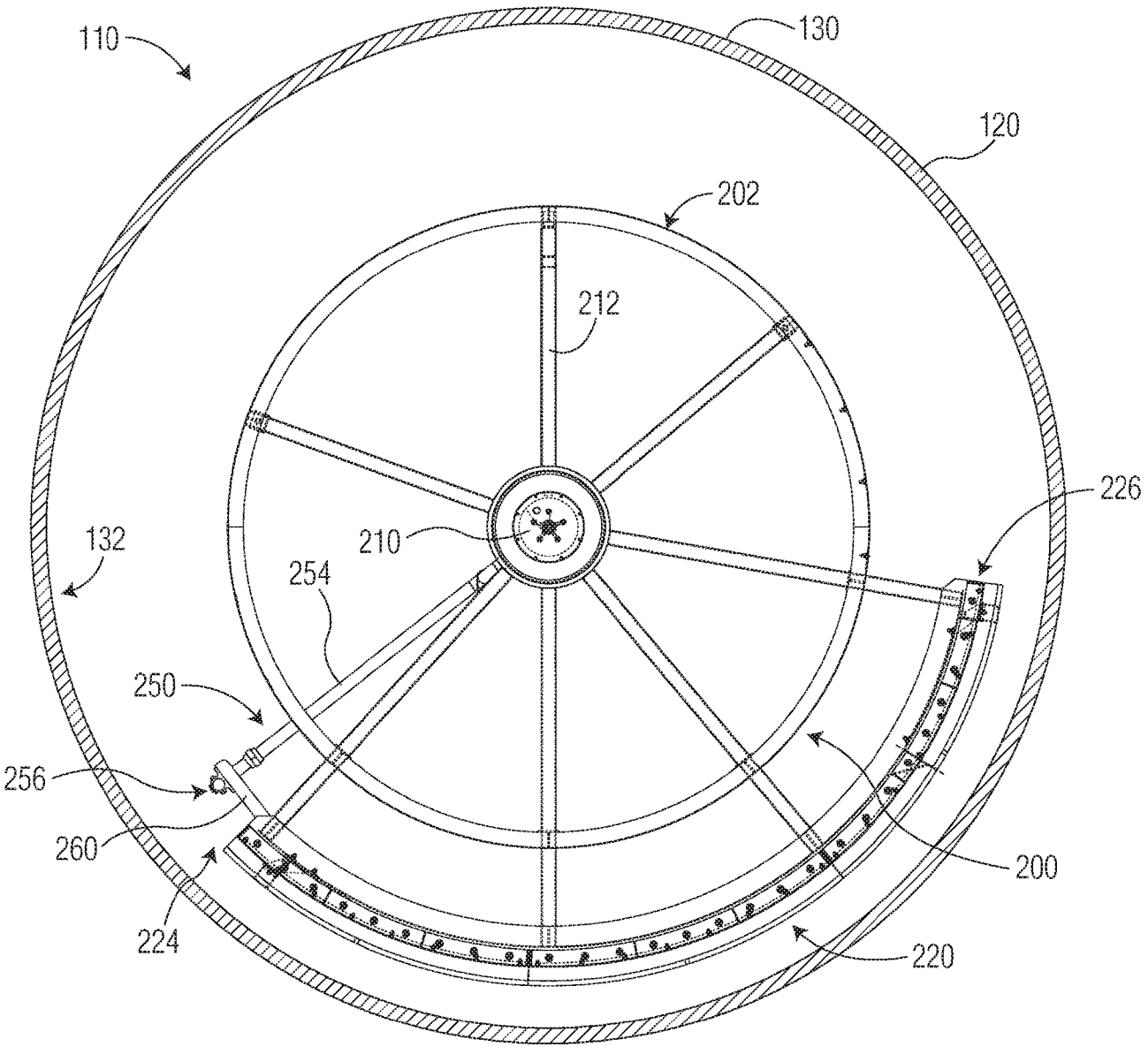
FIG. 3 is a cross-sectional view of a cylindrical dryer illustrating a baffle and a shower assembly according to one embodiment of the present invention.
Figure 4:
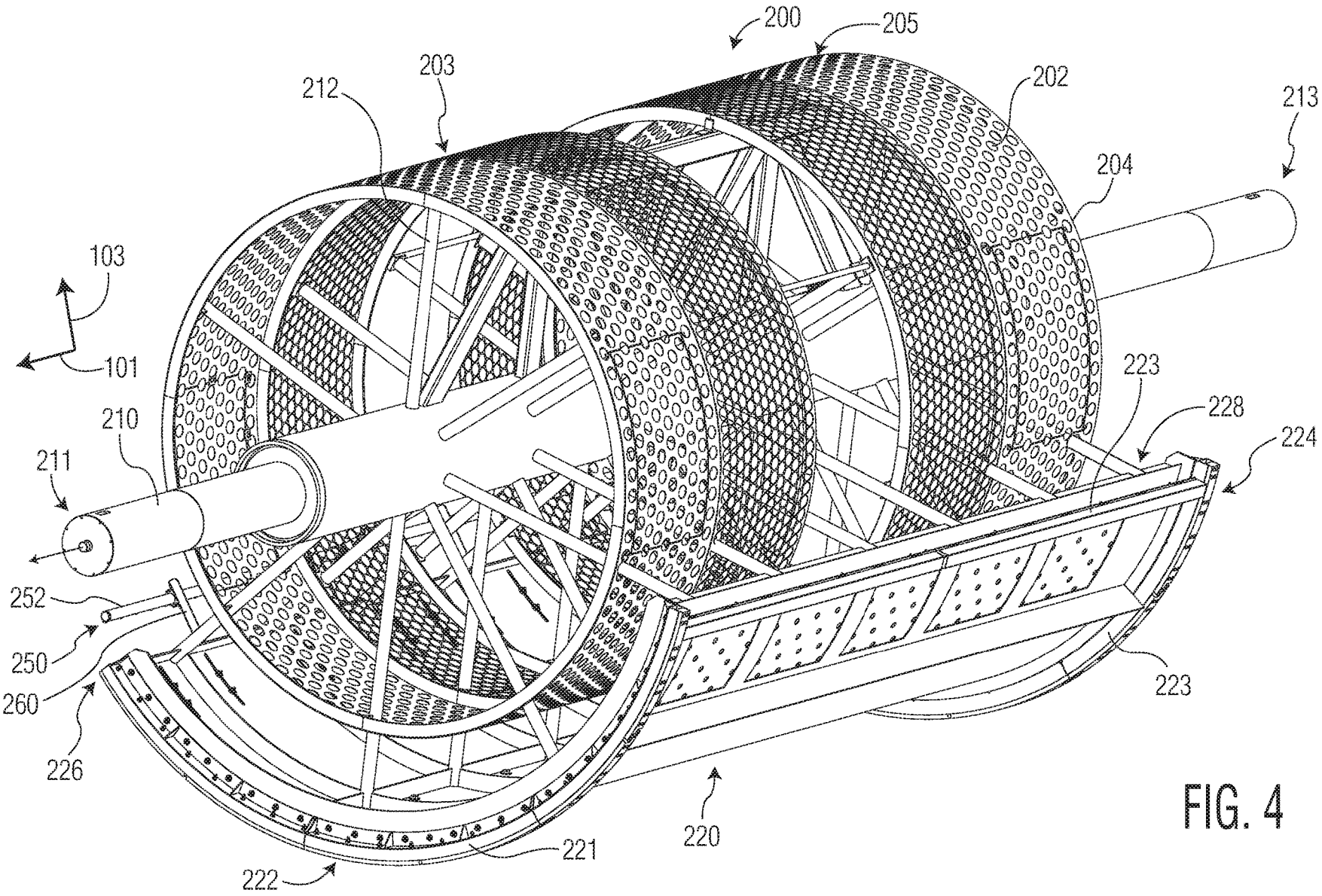
FIG. 4 is a perspective view of a baffle and shower assembly according to one embodiment of the present invention.
Figure 5:
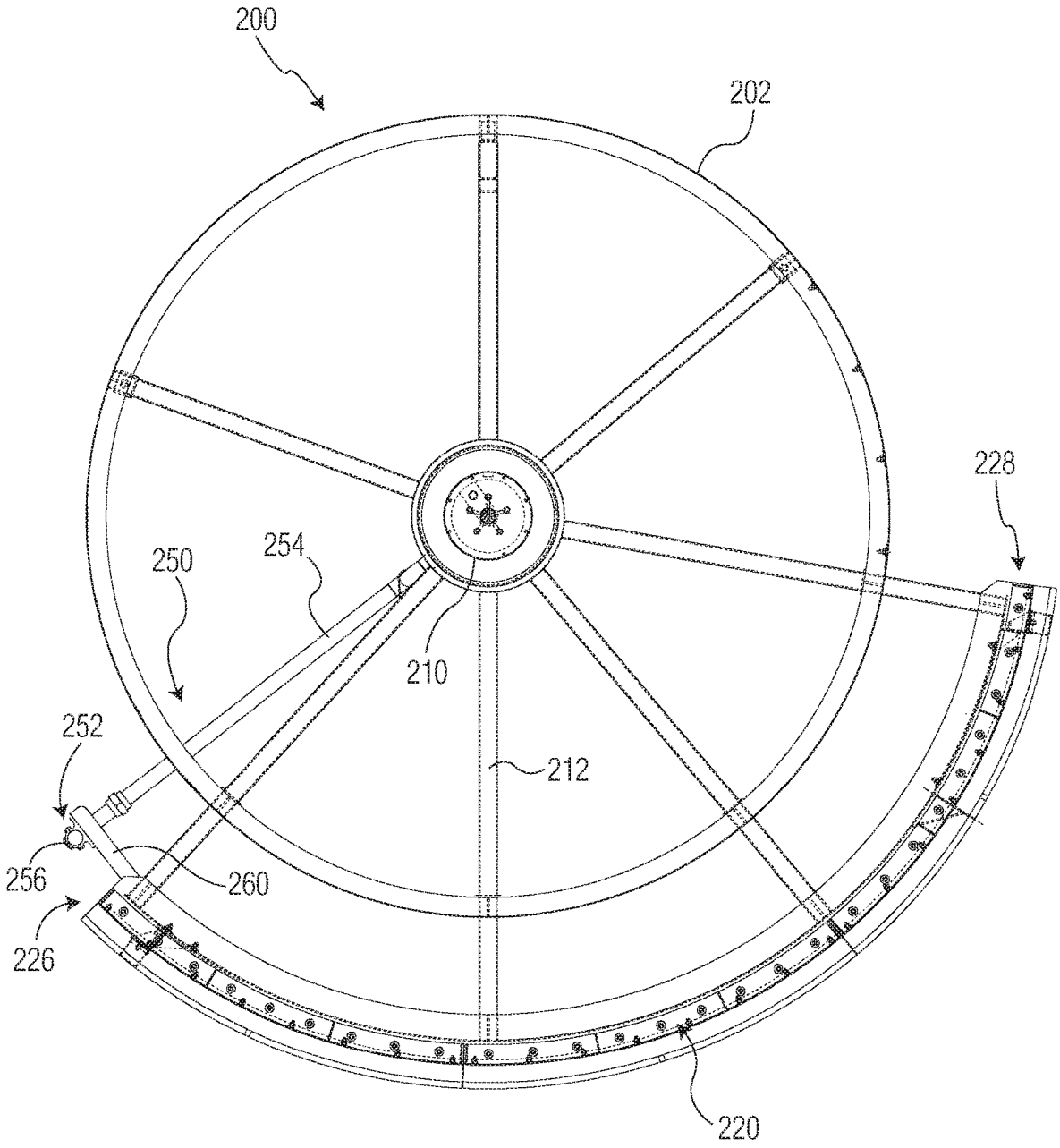
FIG. 5 is an end-view of a baffle and a shower assembly according to one embodiment of the present invention.
Figure 6:
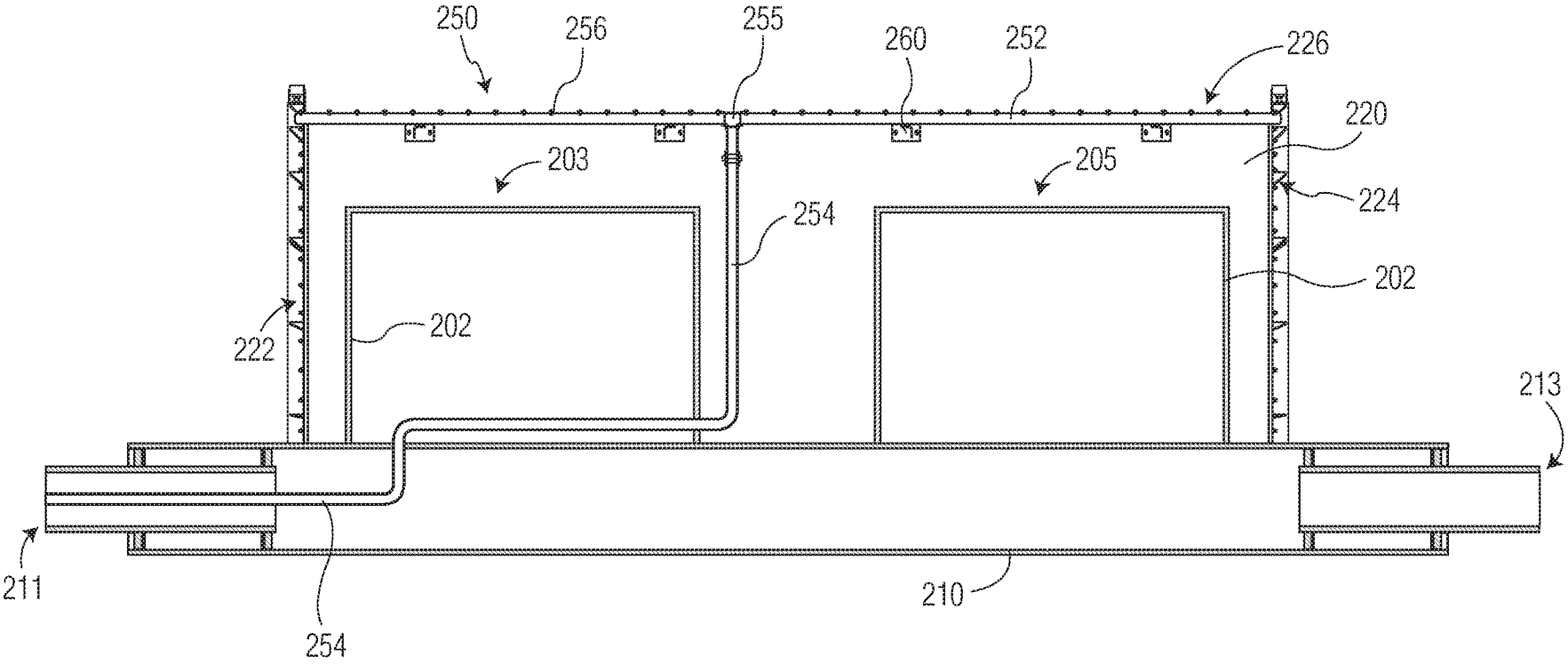
FIG. 6 is a cross-sectional view of a portion of a baffle and a shower assembly.
Figure 7:
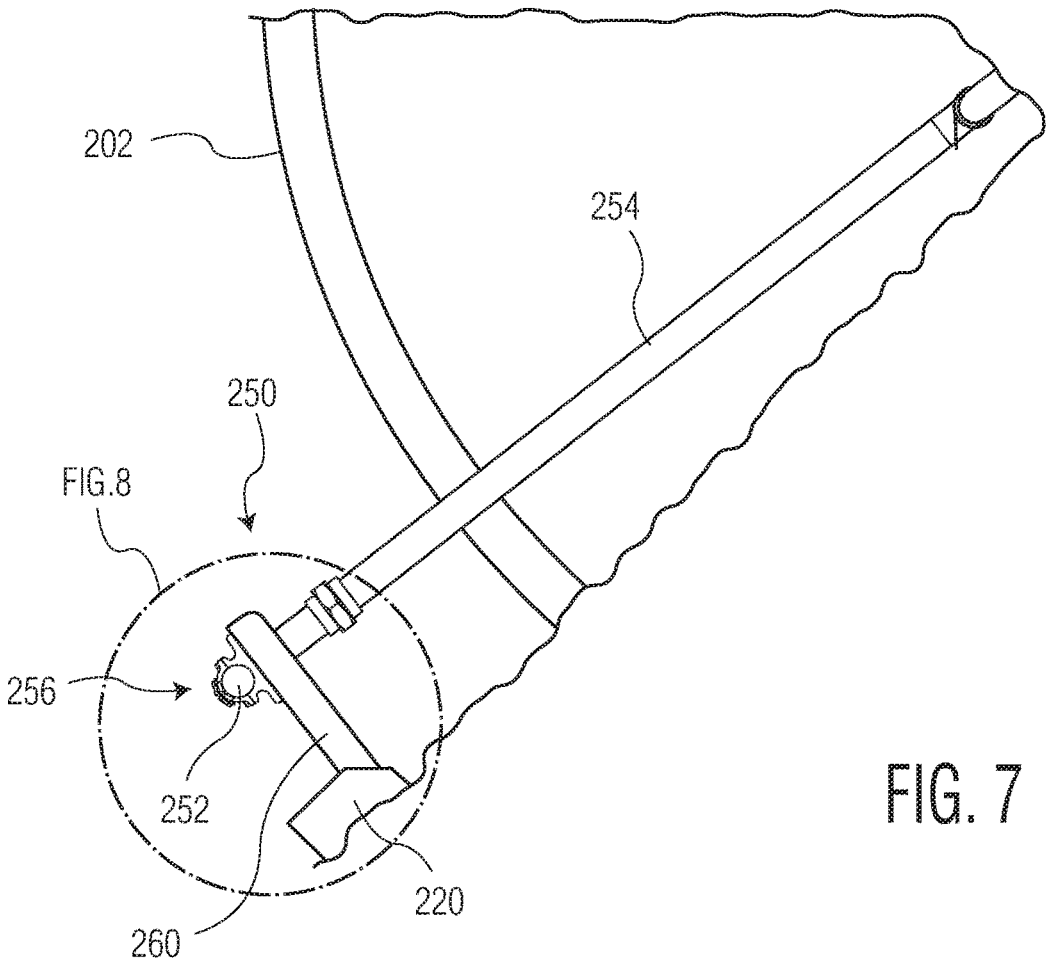
FIG. 7 is a detailed view of a shower assembly.
Figure 8:
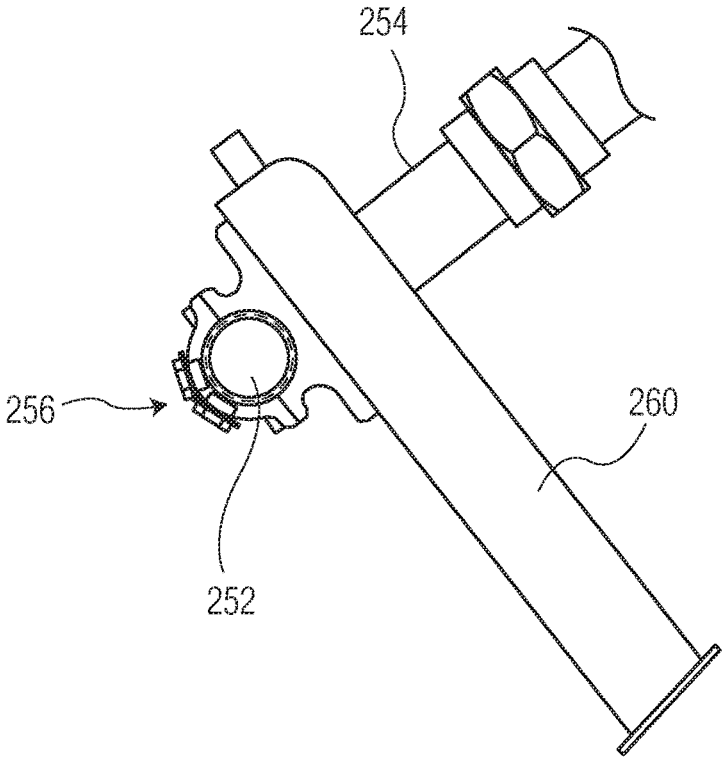
FIG. 8 is a detailed view of a shower assembly.

With reference now to FIGS. 2 through 4, within the cylindrical deck 120 is a baffle 200 and a shower assembly 250. In use pressurized drying medium entering, or exiting, the cylindrical deck 120 passes through a baffle 200, which generally redistributes the drying medium in order to provide a uniform and even flow along the dryer width. The baffle 200 may be fabricated with an outer shell 202 having a pattern of baffle orifices 204 disposed thereon (shown in FIG. 4). The baffle orifices 204 may vary in diameter, spacing, and arrangement across the width and length of the baffle shell 202 to facilitate the desired even and uniform flow. Further, the baffle 200 may be provided with a dead plate 220, which prevents cold machine room air from entering the drying cylinder 110 in use.

As noted above and as illustrated in FIG. 4, the baffle 200 may have a porous outer shell 202 that is attached to a stationary support shaft 210 concentrically positioned with respect to the cylindrical baffle shell 202. The baffle 200, in turn, is generally concentrically positioned within the cylindrical deck 120 of the drying cylinder 110 (as shown in FIGS. 2 and 3). The baffle support shaft 210 extends from a first side or end of the baffle 200 to a second and opposite side and may be coupled to the dryer journal to create a dryer assembly. In use the baffle 200 is generally fixed and does not rotate about the central axis of the support shaft 210. Although the baffle is generally fixed in use, its position within the drying cylinder may be adjusted periodically as needed to ensure the desired air flow and proper sealing of the dryer.

The cylindrical baffle shell 202 is connected to the support shaft 210 by a plurality of spokes 212 extending radially outward from the shaft 210. The number, spacing and arrangement of the spokes may vary depending on the structural needs of the baffle and the need to facilitate access for inspection and maintenance. Further, the cylindrical baffle shell may extend lengthwise continuously across the entire length of the baffle or may comprise one or more intermittent gaps. For example, as illustrated in FIG. 4, the cylindrical baffle shell 202 comprises first and second sections 203, 205, while the middle portion of the baffle 200 does not comprise an outer surface disposed radially outward from the support shaft 210.

The baffle may be provided with various plates and seals to prevent cooler, ambient air from entering the drying cylinder. For example, as illustrated in FIGS. 2 and 3 the through-air dryer 100 includes an internal baffle 200 disposed centrally within the drying cylinder 110. The baffle 200 includes a dead plate 220 supported by spokes 212 extending radially outward from the support shaft 210. The dead plate 220 may be provided with end dam seals 221, 223 disposed at first and second edges 222, 224 (shown in FIG. 4) and side seal assemblies disposed at trailing and leading edges 226, 228. The dead plate and associated seals may prevent air from directly entering the drying cylinder in use.

The baffle 200 further comprises a shower assembly 250 fixedly attached thereon. Preferably the shower assembly 250 is attached to the baffle 200 and disposed inside the drying cylinder 110 in a state of extending parallel to the center axis 105. The shower assembly 250 may comprise a spray conduit 252 and a wash fluid supply conduit 254 and a plurality of liquid spray nozzles 256 disposed on the spray conduit 252 at fixed intervals along the length direction thereof. The liquid spray nozzles 256 are arranged to spray wash fluid outwardly from the central axis 105 towards the inner surface 132 of the drying cylinder 110.

The wash fluid is sprayed on the inner surface of the drying cylinder and preferably through the perforated surface to remove debris disposed thereon. In certain preferred embodiments the drying cylinder, which is preferably in a cooled state, is rotated while wash fluid is sprayed on its inner surface by the shower assembly, which is fixedly attached to the baffle and is not rotating. In use, the wash fluid, which in certain instances may be pressurized and heated water, is delivered to the liquid spray nozzles 256 by a spray conduit 252 extending generally parallel to the support shaft 210 central axis 105. The spray conduit 252 is in turn supplied by a wash fluid supply conduit 254 which extends radially outward from the support shaft 210 and past the baffle shell 202. The wash fluid supply conduit may be connected to an external conduit in fluid communication with a wash fluid supply, such as a storage tank in which a supply of wash fluid is maintained. A pump may be provided to draw wash fluid from the storage tank and pump it under pressure to the spray conduit for discharge by the spray nozzles.

With reference now to FIGS. 5 through 8, the shower assembly 250 comprises a longitudinally extending spray conduit 252 having a plurality of fluid spray nozzles 256 disposed thereon. The nozzles 256 may include any one of a number of well-known fluid spray nozzles including, for example, jet spray, cone spray, fan spray or dual angle spray nozzles. In a particularly preferred embodiment, the nozzles are flat fan nozzles, which may be oriented in either the horizontal or vertical plane relative to the operator. In a particularly preferred embodiment, each of the nozzles are substantially similar such that the volume flow rates and spray geometries are substantially uniform across the length of the spray conduit.

In certain preferred embodiments the spray conduit 252 is mounted to the baffle 200, more particularly the dead plate 220, at spaced apart mounting blocks 260. A wash fluid supply conduit 254 extends radially outward from the support shaft 210 and is connected to the spray conduit 252 using a T-shaped union 255 (shown in FIG. 6). Further, portions of the conduit, such as the radially extending portion of the wash fluid supply conduit, may be secured to one or more of the baffle components, such as a baffle spoke.

A portion of the wash fluid supply conduit 254 is disposed within the baffle support shaft 210 and extends longitudinally therein to a first end 211 to a second end 213. The fluid supply conduit may extend further through the dryer journal where it may exit from one end of the through-air drying apparatus and be connected to a wash fluid supply source as described above. In this manner, the shower assembly may be fixed within the outer rotary surface of the through-air dryer and may spray wash fluid along its inner surface as the dryer surface is rotated about the shower assembly.

To effectively apply wash fluid to the inner surface of the dryer and remove debris therefrom, the spray conduit is provided with staggered sets of nozzles extending axially outward therefrom. The nozzles are arranged to spray the inner surface of the dryer as it is rotated about the shower assembly. To this end, and as illustrated in FIGS. 2 and 3, the spray conduit 252 is positioned above and in vertical alignment with the axis of rotation of the dryer. In this manner, the spray conduit 252 is being provided with a plurality of nozzles 256 oriented to discharge wash fluid outwardly onto the inner surface 132 of the drying cylinder 110.

In certain embodiments the nozzles may be oriented at different angles, relative to one another, to project wash fluid across a broad portion of the dryer surface. For example, the nozzles may be arranged in sets and a first set of nozzles may be inclined upwardly in the direction of rotation of the dryer relative to a second set of nozzles. In other instances, each successive set may be inclined at an angle from about 5 to about 50 degrees, such as from about 10 to about 20 degrees, relative to each other. Such arrangement ensures thorough washing of the internal surface of the dryer. In other instances, each successive nozzle may be inclined at an angle relative to an adjacent nozzle.

Generally, the number and spacing of the nozzles is non-limiting, although it may be preferred to arrange the nozzles so as to ensure that the entire interior surface of the dryer is sprayed. Further, the nozzles may be spaced and arranged to ensure sufficient impingement of wash fluid within the dryer perforations to dislodge contaminants which may have become entrapped therein.

In particularly preferred embodiments, the shower assembly comprises a spray conduit fixedly attached to the baffle and having from about 50 to about 100, such as from about 60 to about 70 nozzles disposed thereon. The spray conduit is supplied with wash fluid by a single fluid supply conduit extending radially outward from the baffle shaft. The fluid supply conduit may be offset towards one end of the baffle shaft to provide adequate access to the baffle for inspection and maintenance. The nozzles may be spaced apart from one another, from about 10 to about 25 cm, such as from about 12 to about 18 cm and adjacent nozzles may be inclined relative to one another from about 10 to about 20 degrees. In this manner wash fluid may be sprayed in a pattern ranging from about 40 to about 50 degrees and cover the majority of the inner surface of the dryer as it is rotated about the shower assembly.

In any of the foregoing embodiments, the shower assembly can also include one or more features or elements in any one of the wash fluid supply conduits to regulate volume flow rate through various nozzles. In particular, the droplet size, discharge velocity, and spray angles of sprays discharged from the nozzles may be affected by volume flow rate through the nozzles, which may be a function of fluid pressure at the inlets of these nozzles. The shower assembly can, therefore, include one or more pressure regulators or restriction plates within one or more wash fluid conduits to reduce fluid pressures communicated from the inlets and to reduce volume flow rate through particular nozzles to achieve a target range of droplet sizes, discharge velocities, and spray angles for sprays discharged from these nozzles. For example, the shower assembly may comprise one or more restriction plates (e.g., orifice plates, regions of reduced cross-sectional area) within one or more of the wash fluid conduits to reduce fluid pressure or reduce volume flow rate through the nozzles and thus to reduce droplet size and/or discharge velocity from nozzles.

The shower assembly may also include a pressure regulator ahead of the nozzle inlets configured to regulate an unregulated inlet pressure to a target operating pressure within the shower assembly. For example, the shower assembly can include a diaphragm-type pressure regulator arranged at one or more inlets and configured to reduce the pressure of the supplied wash fluid. In another example, the shower assembly can include a restriction plate or similar orifice ahead of each inlet that cooperates to restrict the volume flow rate through one or more conduits to a particular target range of nozzle exit pressures, such as between 5 to about 8 bars, thereby yielding a flow rate from about 400 to about 800 liters per minute.

To maintain safety of the equipment and operators the shower is preferably operated only when the dryer is not in operation. Generally, clearing of the shower using the assembly of the present invention begins with shutting off the burners and air supply fans to cease the supply of heated air and cooling of the dryer to less than about 60° C. and more preferably less than about 55° C. Once the dryer is cool the drying fabric is removed the dryer may be rotated for washing. With the dryer rotating, but not heated, wash fluid is supplied to the shower. Wash fluid is sprayed onto the interior surface of the dryer as it is rotated. Preferably the shower sprays the wash fluid across a significant portion of the cross-machine directional width of the cylindrical dryer, such as at least about 80 percent of its width, such as at least about 90 percent of its width, and still more preferably across entire cross-machine directional width of the cylindrical dryer. The wash fluid may be sprayed at pressures ranging from about 5 to about 8 bars, such as from about 5.5 to about 7.5 bars. The flow rate of wash fluid may range from about 400 to about 1,000 liters per minute, such as from about 400 to about 800 liters per minute, such as from about 450 to about 650 liters per minute. Preferably at least a portion of the wash fluid passes through the porous cylindrical deck of the dryer, which may have a honeycomb-like structure, and removes debris as it passes through. Upon completion of washing, residual wash fluid may be purged from the system and the system may be locked out to prevent wash fluid from entering the system during operation of the dryer.

The wash fluid used in the present invention can be any cleaning solution typically employed to clean papermaking machinery. Depending upon the chemistry of the particular equipment, wash fluid may be alkaline, acid, anionic, or nonionic. The wash fluid may comprise one or more surfactants, acid or base wetting agents, chelants or sequestrants. In certain instances, the wash fluid is water, which may be heated and may have a temperature ranging from about 70 to about 120° C., such as from about 80 to about 100° C.

Numerous modifications may be made in the invention without departing from its spirit and purpose, and various modifications have already been set forth and it should be readily apparent that various additional changes and modifications may be made in the structural details of the shower assembly within the scope of the appended claims. It is to be understood that the size of the through-air dryer and associated shower assembly do not constitute a limitation in the invention and that its size and the dimensions of its parts may vary. Similarly, the number and arrangement of shower assemblies may be varied depending upon size of the through-air dryer and the washing needs. For example, certain types of through-air dryers may require one or more shower assemblies to obtain the desired degree of cleanliness. Accordingly, in view of the foregoing description, it will be apparent to one of ordinary skill in the art that the following embodiments are within the scope of the present invention:

In a first embodiment the invention provides a through-air drying apparatus having radial, axial and tangential directions and rotatable about a central axis, the drying apparatus comprising a through-air drying apparatus having radial, axial and tangential directions, the drying apparatus comprising a drying cylinder rotatable about a central axis having a porous cylindrical deck having an inner and outer surface, a pair of spaced apart headers and a journal supporting the headers; a baffle disposed within the rotatable cylinder, the baffle having a baffle support shaft that is axially aligned with the journal, a cylindrical shell and a dead plate; and a shower assembly attached to the dead plate, the shower assembly comprising a wash fluid supply conduit extending radially outward from the baffle support shaft, a spray conduit extending substantially parallel to the support shaft and in fluid communication with the wash fluid supply conduit and a plurality of immediately successive nozzles disposed on the spray conduit.

In a second embodiment the invention provides the invention of the first embodiment wherein the shower assembly is disposed radially outward from the cylindrical shell of the baffle.

In a third embodiment the invention provides the invention of either the first or the second embodiments wherein the baffle support shaft comprises an axially extending central portion and at least a portion of the wash fluid supply conduit is disposed within the axially extending central portion.

In a fourth embodiment the invention provides the invention of any one of the first through third embodiments wherein the baffle support shaft and the journal comprise axially extending central portions and at least a portion of the wash fluid supply conduit is disposed within the axially extending central portions.

In a fifth embodiment the invention provides the invention any one of the first through fourth embodiments wherein the dead plate is attached to the baffle support shaft by a plurality of spokes and has a leading edge and a trailing edge relative to the direction of rotation of the rotatable cylinder and the shower assembly is attached to the leading or the trailing edge.

In a sixth embodiment the invention provides the invention of any one of the first through fifth embodiments wherein the porous cylindrical deck has a honeycomb structure and when the rotatable cylinder is rotated the nozzles spray a wash fluid onto the inner surface of the porous cylindrical deck causing debris accumulated within the honeycomb structure to flow through the structure to the outer surface of the porous cylindrical deck for discharge.

In a seventh embodiment the invention provides the invention of any one of the first through sixth embodiments wherein the successive nozzles are inclined at an angle relative to one another to direct wash fluid onto the inner surface of the porous cylindrical deck at different angles.

In an eighth embodiment the invention provides the invention of any one of the first through seventh embodiments the porous cylindrical deck has a cross-machine direction width and the nozzles are disposed so as to spray a wash fluid across at least 80 percent of the deck width.

In a ninth embodiment the invention provides the invention of any one of the first through eighth embodiments wherein the successive nozzles are arranged in sets and the sets are inclined at an angle from about 10 to about 20 degrees relative to each other.

In a tenth embodiment the invention provides the invention of any one of the first through ninth embodiments wherein the nozzles are selected from the group consisting of jet spray, cone spray, fan spray and dual angle spray nozzles.

What is claimed is:

1. A through-air drying apparatus having radial, axial and tangential directions, the drying apparatus comprising:

a. a drying cylinder rotatable about a central axis, the dryer cylinder comprising a porous cylindrical deck, a pair of spaced apart headers and a journal supporting the pair of spaced apart headers;

b. a baffle disposed within the drying cylinder, the baffle comprising a baffle support shaft that is axially aligned with the journal, a cylindrical shell and a dead plate wherein the dead plate is attached to the baffle support shaft by a plurality of spokes and has a leading edge and a trailing edge relative to the direction of rotation of the rotatable cylinder; and c. a shower assembly attached to the leading or the trailing edge of the dead plate, the shower assembly comprising a wash fluid supply conduit extending radially outward from the baffle support shaft, a spray conduit extending substantially parallel to the baffle support shaft and in fluid communication with the wash fluid supply conduit and a plurality of nozzles disposed on the spray conduit.

2. The through-air drying apparatus of claim 1 wherein the shower assembly is disposed radially outward from the baffle cylindrical shell.

3. The through-air drying apparatus of claim 1 wherein the baffle support shaft comprises an axially extending central portion and at least a portion of the wash fluid supply conduit is disposed within the axially extending central portion.

4. The through-air drying apparatus of claim 1 wherein the baffle support shaft and the journal comprise axially extending central portions and at least a portion of the wash fluid supply conduit is disposed within the axially extending central portions.

5. The through-air drying apparatus of claim 1 wherein the porous cylindrical deck comprises a honeycomb structure and when the rotatable cylinder is rotated the nozzles spray a wash fluid onto the inner surface of the porous cylindrical deck causing debris accumulated within the honeycomb structure to flow through the structure to the outer surface of the porous cylindrical deck for discharge.

6. The through-air drying apparatus of claim 1 wherein the plurality of nozzles are inclined at an angle relative to one another to direct wash fluid onto the inner surface of the porous cylindrical deck at different angles.

7. The through-air drying apparatus of claim 1 wherein the plurality of nozzles are arranged in sets and the sets are inclined at an angle from about 10 to about 20 degrees relative to each other.

8. The through-air drying apparatus of claim 1 wherein the plurality of nozzles are spaced apart from one another from about 12 to about 18 cm and successive nozzles are inclined relative to one another from about 10 to about 20 degrees.

9. The through-air drying apparatus of claim 1 wherein the plurality of nozzles are selected from the group consisting of jet spray, cone spray, fan spray and dual angle spray nozzles.

* * * * *